US007565974B2

(12) United States Patent
Adams, Jr.

(10) Patent No.: US 7,565,974 B2
(45) Date of Patent: Jul. 28, 2009

(54) BOTTLED BEVERAGE HOLDING LUGGAGE

(76) Inventor: A. Stanley Adams, Jr., 14504 Sterling Oaks Dr., Naples, FL (US) 34110

( * ) Notice: Subject to any disclaimer, the term of this patent is extended or adjusted under 35 U.S.C. 154(b) by 0 days.

(21) Appl. No.: 11/842,675

(22) Filed: Aug. 21, 2007

(65) Prior Publication Data

US 2009/0050429 A1 Feb. 26, 2009

(51) Int. Cl.
*B65D 65/00* (2006.01)

(52) U.S. Cl. ..... 206/427; 206/139; 190/109

(58) Field of Classification Search ..... 206/139, 206/427, 545, 589, 593, 561; 190/102, 109, 190/110

See application file for complete search history.

(56) References Cited

U.S. PATENT DOCUMENTS

| | | | | | |
|---|---|---|---|---|---|
| 2,464,069 | A | * | 3/1949 | Benson | 206/466 |
| 2,979,246 | A | * | 4/1961 | Liebeskind | 206/523 |
| 3,203,612 | A | * | 8/1965 | Schaefer | 229/120.36 |
| 3,656,650 | A | * | 4/1972 | Frater | 220/533 |
| 3,942,709 | A | * | 3/1976 | Gepfer | 229/120.36 |
| 4,261,465 | A | * | 4/1981 | Thomas | 206/708 |
| 4,428,484 | A | * | 1/1984 | Rattay et al. | 206/548 |
| 4,506,769 | A | * | 3/1985 | Franco et al. | 190/108 |
| 4,533,050 | A | * | 8/1985 | Bake, Jr. | 206/545 |
| 4,546,883 | A | | 10/1985 | Youngdale | |
| 4,602,715 | A | * | 7/1986 | Sarver et al. | 206/523 |
| 4,610,286 | A | * | 9/1986 | Cyr | 206/316.2 |
| 4,628,705 | A | * | 12/1986 | Nave | 62/457.5 |
| 4,721,237 | A | * | 1/1988 | Leslie | 224/148.3 |
| 4,842,032 | A | * | 6/1989 | Mastronardo | 206/308.1 |
| 5,095,718 | A | * | 3/1992 | Ormond et al. | 62/457.5 |
| 5,213,215 | A | | 5/1993 | Prevot | |
| 5,219,072 | A | | 6/1993 | Sauer | |
| 5,553,710 | A | * | 9/1996 | Takama | 206/561 |
| 5,567,055 | A | * | 10/1996 | Smith | 383/38 |
| 5,630,537 | A | * | 5/1997 | Sciacca | 224/629 |
| 5,715,953 | A | | 2/1998 | Brown | |
| 5,758,513 | A | * | 6/1998 | Smith | 62/457.5 |
| 5,785,239 | A | * | 7/1998 | Campbell et al. | 229/120.36 |
| 6,050,374 | A | | 4/2000 | Johnson | |
| 6,053,317 | A | | 4/2000 | Morris et al. | |
| 6,067,813 | A | * | 5/2000 | Smith | 62/371 |
| 6,109,404 | A | | 8/2000 | Bishop | |
| 6,325,189 | B1 | | 12/2001 | King et al. | |
| 6,561,328 | B1 | | 5/2003 | Huang | |
| 6,640,944 | B2 | * | 11/2003 | Adams | 190/110 |
| 2005/0126953 | A1 | * | 6/2005 | Lantz | 206/593 |
| 2006/0137949 | A1 | * | 6/2006 | Levinson et al. | 190/18 A |

* cited by examiner

*Primary Examiner*—David T Fidei
(74) *Attorney, Agent, or Firm*—The Livingston Firm; Edward M. Livingston; Bryan L. Loeffler

(57) ABSTRACT

A bottled beverage holding luggage (1) having a core (14), a vertical wall (13) located within the core and a plurality of horizontal walls (12) located within the core (14). The horizontal walls (12) intersect with the vertical wall (13) to form a plurality of openings (10) for the acceptance of bottles (9), which may be bottled beverages. Shock-absorbent sleeves (11) having at least one aperture (15) may be inserted into the openings (10). Thus, the bottles (9) are placed within the sleeves (11) and the sleeves (11) are ultimately placed within the openings (10) in the core (14) to protect the bottles (9) from breakage during transit. Alternatively, the core (14) may include removable horizontal and vertical shelves (17 and 22) which form the openings (10) or include a plurality of foldable dividers (27) which form the openings (10) for acceptance of the bottles (9). The core (14) may be removable from a luggage case (30), built into a luggage case (30) or have wheels (8), a handle (5) and a rigid exterior shell (41) so as to be its own luggage case (30).

34 Claims, 4 Drawing Sheets

BOTTLED BEVERAGE HOLDING LUGGAGE

BACKGROUND OF THE INVENTION

This invention relates to bottled beverage holding luggage, more particularly, bottled beverage holding luggage that permits a person to conveniently and safely transport a plurality of bottled beverages to and from one locality to another.

Currently, there exists a plethora of various styles and forms of luggage for a traveler, including expandable luggage, luggage having wheels thereon to permit easier transportation of the luggage, luggage having extendable handles, etc. However, these alternative forms and styles of luggage concentrate on re-designing the exterior of the luggage, rather than focusing on the interior compartment of the luggage.

Frequently, travelers desire to transport their own bottle(s) of wine, spirit, alcoholic beverages, drinks, etc. as they are uncertain whether their ultimate destination will have on supply their desired drink of choice. In addition, if the travelers transport their own beverages, they also save on expensive motel/hotel/resort fees associated with purchasing same. Finally, when traveling to other nations, oftentimes imported beverages, such as wine, have spent hours in the sun on a dock or in customs-controlled storage areas which lack proper climate control, thus resulting in the spoiling of the beverage which is ultimately purchased by the travelers.

During recent years, however, commercial airlines, steamship companies and other large-scale transportation systems have cracked-down on the amount and types of items carried onboard. For instance, there is a limit on the amount of any type of fluid a person may physically carry onboard a commercial airliner due to safety restrictions. Thus, many travelers oftentimes find themselves packing bottles of fluids in luggage that is to be examined by security and placed into the cargo area of the airplane. The traveler usually is very cautions in packing such bottle(s), wrapping each one in cloth or other protective means and carefully placing the bottle(s) in the center of the luggage, in order to prevent breakage of the bottle(s), which may be wine, spirits, alcoholic beverages or any other type of bottle(s) containing liquid. However, due to time constraints, oftentimes the security personnel are not cautious when searching through the luggage and disrupts the careful packaging of the bottle, thereby making it more susceptible to breakage. In addition, when a staff member is depositing the luggage into the cargo area, oftentimes the luggage is thrown onto a conveyer belt, thus possible breaking the bottle(s) inside the luggage. Finally, when the luggage is located in the cargo area, sometimes luggage is stacked onto one another, thereby creating another opportunity to break the bottle(s).

Furthermore, if the bottle(s) break, then the liquid contained therein is spilled onto the other items located in the luggage, such as clothing. Thus, not only is the bottle(s) ruined if it is broken in transit, but the contents of the luggage as well.

Not only does the aforementioned problem relate to the transportation of the bottle(s) from one local to another, but even if the bottle(s) reach the ultimate destination in tact, oftentimes a person may wish to replenish his/her supply at the ultimate destination, thereby once again risking damage or breakage to the newly supplied bottle(s) when traveling home.

Thus, a need exists for bottled beverage holding luggage that permits a person to conveniently and safely transport a plurality of bottled beverages to and from one locality to another.

The relevant prior art includes the following references:

| U.S. Pat. No. (U.S. unless stated otherwise) | Inventor | Issue/Publication Date |
|---|---|---|
| 6,561,328 | Huang | May 13, 2003 |
| 6,325,189 | King et al. | Dec. 04, 2001 |
| 6,109,404 | Bishop | Aug. 29, 2000 |
| 6,050,374 | Johnson | Apr. 18, 2000 |
| 5,715,953 | Brown | Feb. 10, 1998 |
| 5,219,072 | Sauer | Jun. 15, 1993 |
| 4,546,883 | Youngdale | Oct. 15, 1985 |
| 6,053,317 | Morris et al. | Apr. 25, 2000 |
| 5,213,215 | Prevot | May 25, 1993 |

SUMMARY OF THE INVENTION

The primary object of the present invention is to provide bottled beverage holding luggage that permits a person to conveniently and safely transport a plurality of bottled beverages from one local to another.

Another object of the present invention is to provide bottled beverage holding luggage that reduces the risk of a bottle breaking during transportation.

A further object of the present invention is to provide bottled beverage holding luggage that is easy to use.

An even further object of the present invention is to provide bottled beverage holding luggage that is durable.

The present invention fulfills the above and other objects by providing bottled beverage holding luggage having a core of a predetermined size and shape, at least one vertical wall made of a predetermined material located within the core, at least one horizontal wall made of a predetermined material located within the core wherein the at least one horizontal wall intersects with the at least one vertical wall and at least one opening for acceptance of at least one bottle formed by the at least one vertical wall intersecting with the at least one horizontal wall. Sleeves having at least one aperture may be inserted into the openings wherein the sleeves are shock-absorbent. In this manner, bottles, which are preferably bottled beverages, are placed within the sleeves, which in turn are ultimately placed within the openings in the core for protection from breakage during transit. In the alternative, the vertical and horizontal walls themselves may be shock-absorbent to prevent breakage. The core itself may be placed within a conventional luggage case having wheels and an extendable handle or may be placed within a case wherein a carrier having wheels and a handle is used. In addition, the core may be built into a conventional luggage case. A cushioned base and cushioned cover may be placed between the core and the luggage case wherein the cushioned base and cushioned cover covers the openings and/or apertures to further protect the bottled beverages.

Alternatively, the core may have at least one vertical slot and at least one horizontal slot for the acceptance of removable vertical and horizontal shelves therein. When the vertical and horizontal shelves are inserted into the slots, openings are formed for the acceptance of bottled beverages. The shelves are preferably shock-absorbent so as to reduce the risk of breakage of the bottled beverages stored within the openings. Once again, the core may be placed within a luggage case or, in the alternative, the core may be built into the luggage case.

Finally, the core may include foldable dividers located therein to form at least one opening for acceptance of at least one bottle. A securing means, which is preferably a strap having a hook and loop type securing means, an adjustable buckle or any other type of securing means extend across the opening so as to maintain the bottled beverage within the opening during transit. Once again, the core may be placed within a luggage case or, in the alternative, the core may be built into the luggage case.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
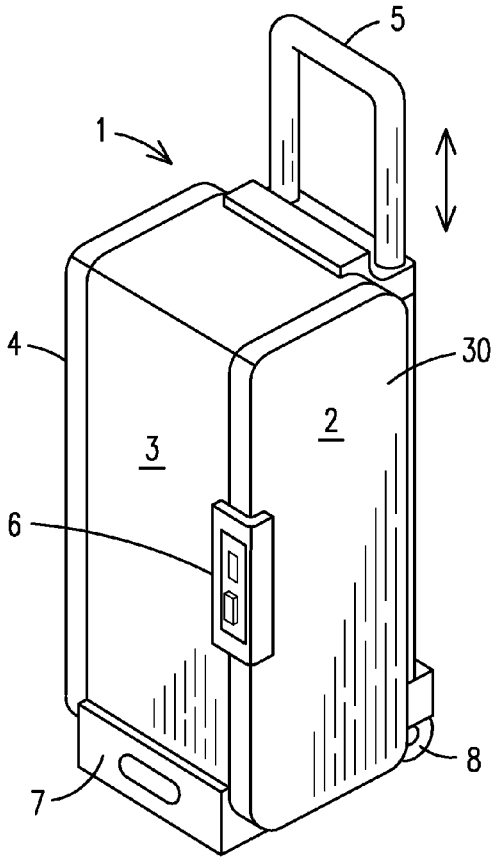
FIG. 1 is a side perspective view of a bottled beverage holding luggage of the present invention located within a luggage case.

For purposes of describing the preferred embodiment, the terminology used in reference to the numbered components in the drawings is as follows:

1. bottled beverage holding luggage, generally
2. lid
3. body
4. base
5. handle

-continued 6. latch
7. foot
8. wheel
9. bottle
10. opening
11. sleeve
12. horizontal wall
13. vertical wall
14. core
15. aperture
16. vertical slot
17. horizontal shelf
18. horizontal shelf support
19. cushion
20. horizontal shelf slot
21. horizontal shelf support edge
22. vertical shelf
23. vertical shelf support
24. securing means
25. fastening means
26. zipper
27. foldable divider
28. strap
29. tab
30. luggage case
31. cushion base
32. cushion cover
33. core first wall
34. core second wall
35. core third wall
36. core fourth wall
37. fabric
38. horizontal slot
39. hinge
40. vertical shelf support edge
41. rigid exterior shell With reference to FIG. 1, a side perspective view of a bottled beverage holding luggage of the present invention located within a luggage case is shown. The bottled beverage holding luggage, generally 1 is preferably placed within a luggage case 30 wherein the luggage case 30 includes a lid 2, a body 3 and a base 4. The luggage case 30 may be placed on a foot 7 having at least one wheel 8 attached thereto and a telescoping, extendable handle 5. The foot 7 provides stability of the luggage case 30 while in an upright position. The handle 5 is used to easily transport the bottled beverage holding luggage 1 along a ground surface and/or to lift the bottled beverage holding luggage 1 for placement within a trunk, on a conveyor belt, etc, during travel. A latch 6 may be located on the exterior of the luggage case 30 so as to prevent unauthorized access to the bottled beverage holding luggage 1.

Figure 2:
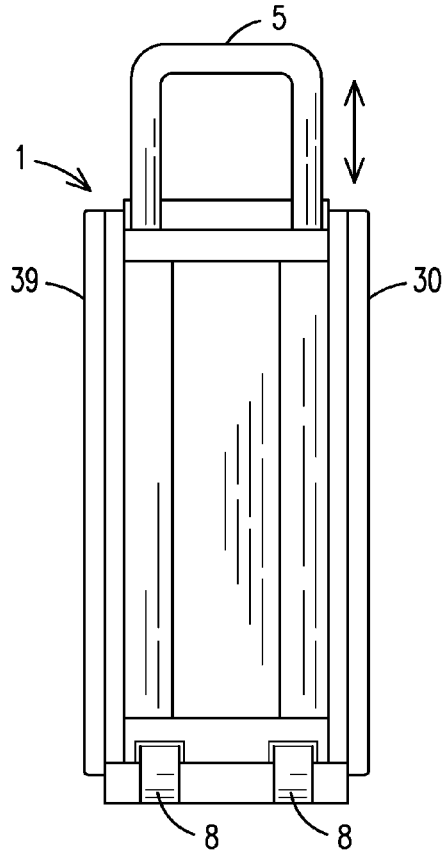
FIG. 2 is a rear view of the bottled beverage holding luggage of FIG. 1.

In FIG. 2, a rear view of the bottled beverage holding luggage of FIG. 1 is shown. A hinge 39, which is preferably a piano hinge but may be any other type of hinge, is used to permit a user to open and close the lid 2 of the luggage case 30 when the latch 6 in FIG. 1 is opened.

Figure 3:
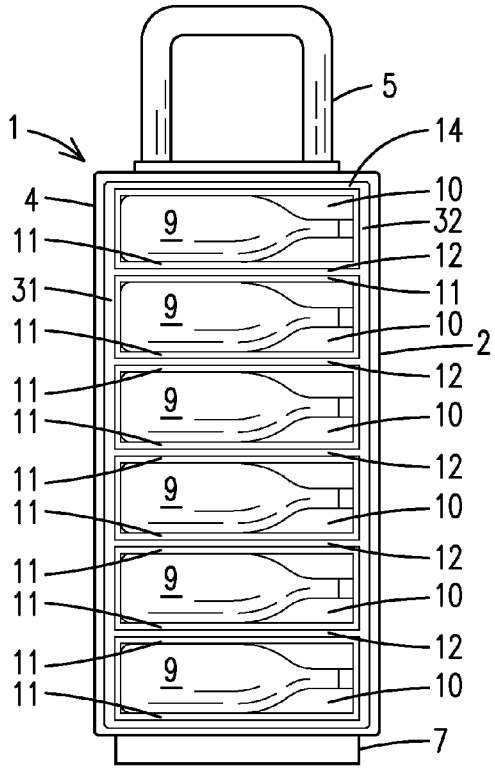
FIG. 3 is a front view of the bottled beverage holding luggage of FIG. 1 wherein the front cover is off.

Next, FIG. 3 shows a front view of the bottled beverage holding luggage of FIG. 1 wherein the front cover is off. The bottled beverage holding luggage 1 of the present invention includes a core 14, which may be rigid, semi-rigid or substantially flexible, includes at least one horizontal wall 12 which assist in forming a plurality of openings 10 for acceptance of a plurality of bottles 9 therein. The horizontal walls 12 may be rigid, semi-rigid or flexible and may be shock-absorbent. Optional sleeves 11, which are preferably shock-absorbent, may be removably or permanently inserted within the openings 10 such that a user may insert the bottle 9 into the sleeve 11 within the opening 10 to provide additional protection for the bottles 9 and to prevent rotation of the bottles 9. A cushion base 31 and a cushion cover 32 may be located between the base 4 and the lid 2, respectively so as to provide additional shock-absorption of the bottles 9 when located within the bottled beverage holding luggage 1.

Figure 4:
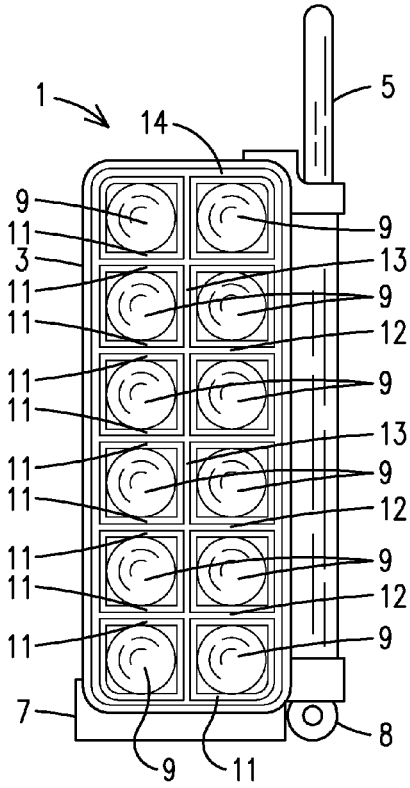
FIG. 4 is a side view of the bottled beverage holding luggage of FIG. 1 wherein the base and cushion base are removed.

With reference to FIG. 4, a side view of the bottled beverage holding luggage of FIG. 1 wherein the lid 2 and cushion cover 32 shown in FIG. 3 are removed is shown. The bottled beverage holding luggage 1 also includes at least one vertical wall 13 located within the core 14. The horizontal walls 12 and vertical wall 13 intersect to create a plurality of openings 10 for the acceptance of sleeves 11 wherein the sleeves 11 are sized and shaped for the acceptance of at least one bottle 9 to protect the bottles 9 and prevent rotation of the bottles 9.

Figure 5:
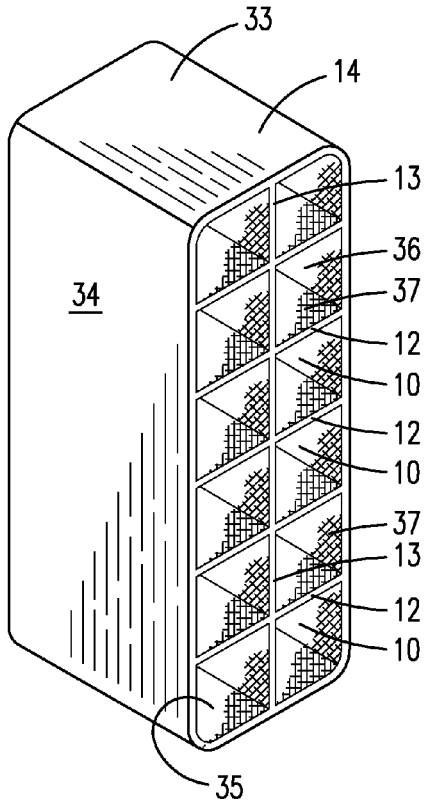
FIG. 5 is a side perspective view of a core of a bottled beverage holding luggage of the present invention.

FIG. 5 shows a side perspective view of a core of a bottled beverage holding luggage of the present invention. The core 14 includes at least one vertical wall 13 and at least one horizontal wall 12 wherein the vertical wall(s) 13 and the horizontal wall(s) 12 intersect with one another to create a plurality of apertures 10. The core 14 preferable includes a core first wall 33 and an opposing core third wall 35 and a core second wall 34 and an opposing core fourth wall 36 wherein the walls 33, 34, 35 and 36 join together to form a substantially square or rectangular core 14. The openings 10 may be lined with a fabric 37 material to decrease the amount of friction between the bottles 9 and the openings 10 when the bottles 9 are placed therein, thus permitting a user to easily remove the bottles 9 from the openings 10.

Figure 6:
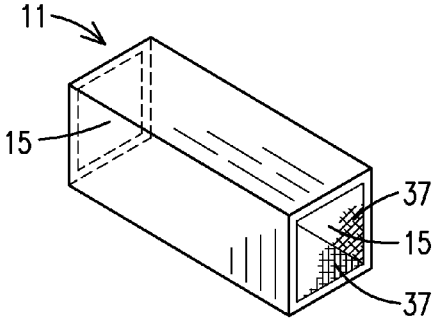
FIG. 6 is perspective plan view of a sleeve used in conjunction with the core of the bottled beverage holding luggage shown in FIG. 5.

In FIG. 6, a perspective plan view of a sleeve used in conjunction with the core of the bottled beverage holding luggage shown in FIG. 5. The sleeve 11 is sized and shaped for acceptance into the openings 10 of the core 14 and includes at least one aperture 15 to permit a user to insert a bottle 9 therein. The sleeves 11 may be lined with a fabric 27 material to decrease the amount of friction between the bottles 9 and the sleeves 11 and may be made of a foam material or any other cushioned or padded material.

Figure 7:
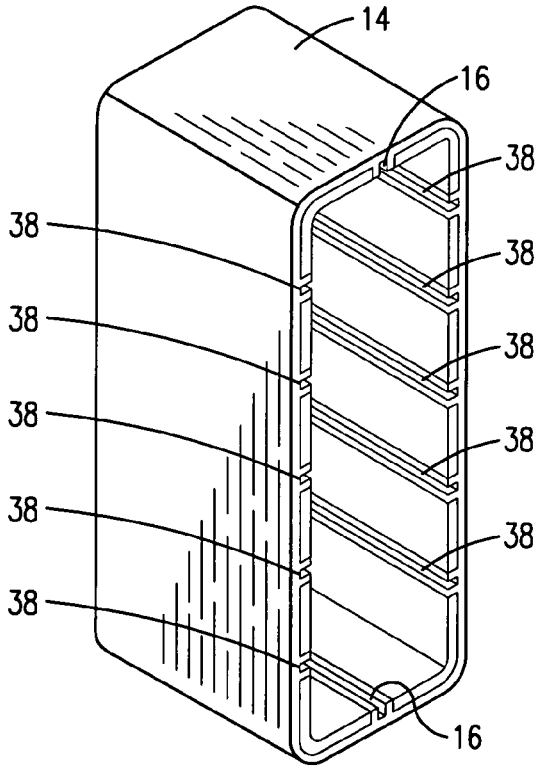
FIG. 7 is a front perspective view of an alternate core of the bottled beverage holding luggage of the present invention.

Next, FIG. 7 shows a front perspective view of an alternate core of the bottled beverage holding luggage of the present invention. Rather than having at least one vertical wall 13 and at least one horizontal wall 12, the core 14 includes at least one vertical slot 16 and at least one horizontal slot 38 internally located within the core 14. In this manner, a person may customize the amount of openings 10 located within the core 14 by removing or adding horizontal shelves 17 (as shown in FIG. 8) and vertical shelves 22 (as shown in FIG. 9).

Figure 8:
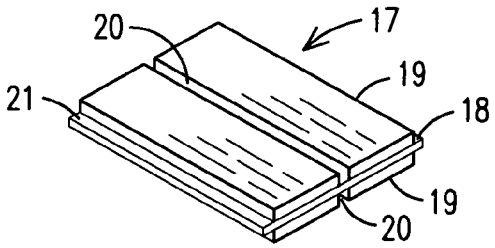
FIG. 8 is a front perspective view of a horizontal divider used in conjunction with the core of the bottled beverage holding luggage of the present invention shown in FIG. 7.

FIG. 8 shows a front perspective view of a horizontal divider used in conjunction with the core of the bottled beverage holding luggage of the present invention shown in FIG. 7. The horizontal shelf 17 preferably includes at least one cushion 19 located on both sides of a horizontal shelf support 18, which is preferably rigid. The cushion 19 provides shock-absorbing padding when the horizontal shelves 17 and vertical shelves 22 (shown in FIG. 9) are inserted into the core 14 of FIG. 7, which ultimately form a plurality of openings 10 for the acceptance of bottles 9. At least one horizontal shelf support edge 21 is located on the horizontal shelf 17 so as to correspond with the horizontal slots 38 located within the core 14. Also, at least one horizontal shelf slot 20 is located within the horizontal shelf 17 for acceptance of a vertical shelf support edge 40 on a vertical shelf 22 as shown in FIG. 9.

Figure 9:
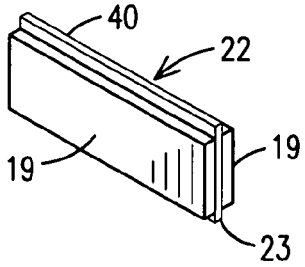
FIG. 9 is a front perspective view of a vertical divider used in conjunction with the core of the bottled beverage holding luggage of the present invention shown in FIG. 7.

FIG. 9 shows a front perspective view of a vertical divider used in conjunction with the core of the bottled beverage holding luggage of the present invention shown in FIG. 7. The vertical shelf 22 includes a vertical shelf support 23, which is preferably rigid. At least one cushion 19 is preferably located on both sides of the vertical shelf support 23 so as to provide shock-absorbing padding when the bottles 9 are inserted into the openings 10 formed by the vertical shelves 22 and the horizontal shelves 17. Because the shelves 22 and 17 are removable from within the core 14, a user may create a customized bottled beverage holding luggage 1 wherein the amount of openings 10 created correspond to the amount of bottles 9 he or she is transporting.

Figure 10:
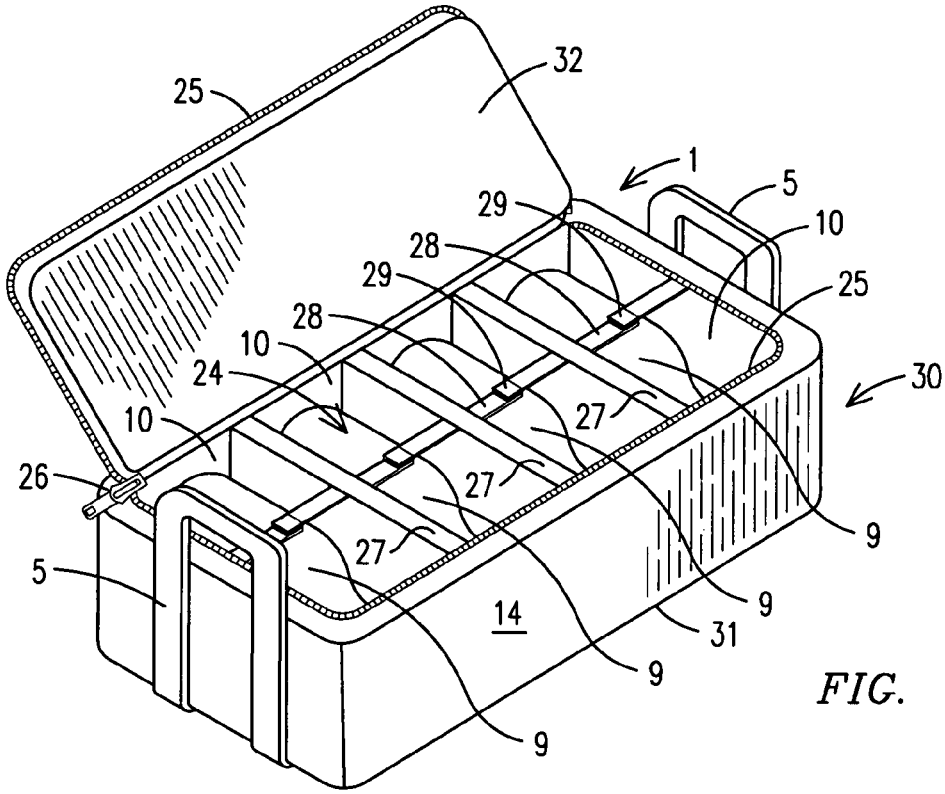
FIG. 10 is a top perspective view of a bottled beverage holding luggage of the present invention that is storable within conventional luggage.

Next, FIG. 10 shows a top perspective view of a bottled beverage holding luggage of the present invention that is storable within conventional luggage. The bottled beverage holding luggage 1 includes a core 14 having a predetermined size and shape that may fit within the confines of conventional luggage. Located within the core 14 is at least one foldable divider 27 that extends along the interior of the core 14 to form a plurality of openings 10 for the acceptance and retention of bottles 9. A securing means 24, which is preferably at least one strap 28 having a tab 29 with hook and loop type material, a buckle or any other fastening means, is used to retain the bottles 9 within the openings 10. The cushion cover 32 may be removably secured to the core 14 via a fastening means 25, which may be a zipper 26, buttons, hook and loop type material or any other fastening means. The zipper 26 is preferably a continuous zipper 26 that is located on all edges of the cushion cover 32 to permit removal of the cushion cover 32 from the core 14. The cushion base 31 provides an additional shock-absorbent cushion to prevent breakage of the bottles 9. At least one handle 5 may be secured on the exterior of the core 14 for easy removal of the bottled beverage holding luggage 1 from the luggage.

Figure 11:
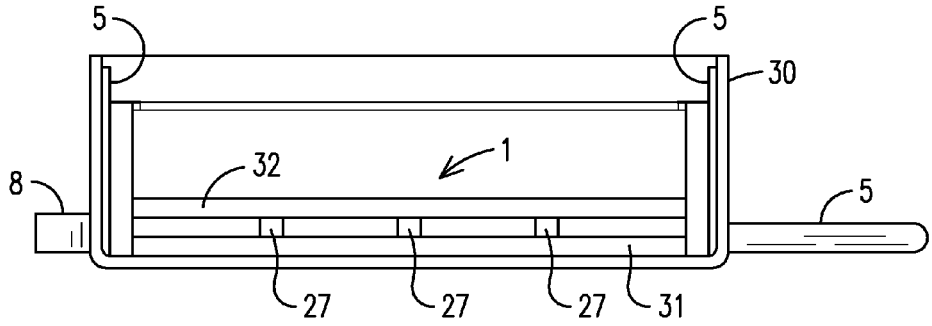
FIG. 11 is a cut-away view of the bottled beverage holding luggage shown in FIG. 10 located within conventional luggage when not in use.

FIG. 11 shows a cut-away view of the bottled beverage holding luggage shown in FIG. 10 located within conventional luggage when not in use. When the bottled beverage holding luggage 1 shown in FIG. 10 is not in use, it may easily be stored within a luggage case 30 by collapsing the bottled beverage holding luggage 1 by removing the cushion cover 32 from the core 14, folding down the foldable dividers 27 and compressing the core 14. In this manner, a person may utilize the internal holding area of the luggage case 30 for clothes and other items.

Figure 12:
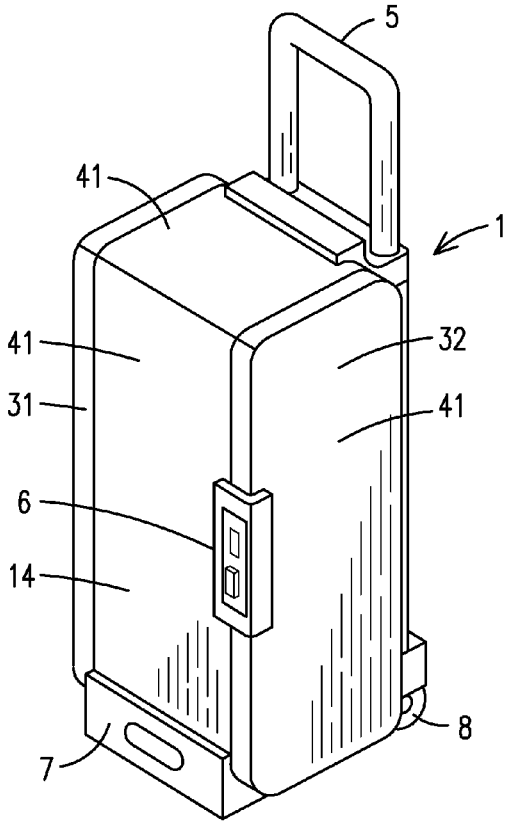
FIG. 12 is a side perspective view of a bottled beverage holding luggage of the present invention having wheels secured thereto.
Figure 13:
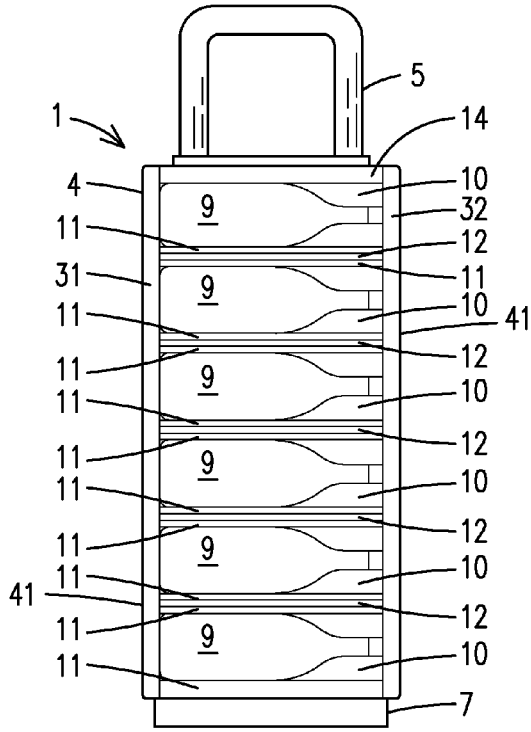
FIG. 13 is a front view of the bottled beverage holding luggage of FIG. 12 wherein the cushion cover is open.

Finally, with reference to FIGS. 12 and 13, varying views of a bottled beverage holding luggage of the present invention having wheels secured thereto. Rather than having the bottled beverage holding luggage 1 inserted into a luggage case 30, the bottled beverage holding luggage 1 shown in FIG. 12 is a stand-alone luggage wherein the cushion cover 32, the cushion base 31 and the core 14 have a rigid exterior shell 41 to protect the bottles 9 located therein. The core 14, which may include a plurality of openings 10 and sleeves 11 (as shown in FIGS. 3-6 and FIG. 13), a plurality of removable shelves (17 and 18) (as shown in FIGS. 7-9) or plurality of foldable dividers (27) (as shown in FIG. 10), includes at least one wheel 8 and at least one handle 5, which is preferably telescoping, for easy transportation.

The use of the present invention permits a person to conveniently and safely transport a plurality of bottled beverages from one locality to another.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

The invention claimed is:

1. A bottled beverage holding luggage comprising:

a core having a predetermined size and shape;

at least one vertical wall made of a predetermined material located within said core;

at least one horizontal wall made of a predetermined material located within said core wherein said at least one horizontal wall intersects with said at least one vertical wall;

at least one opening for acceptance of at least one bottle formed by said at least one vertical wall intersecting with said at least one horizontal wall; and at least one sleeve of a predetermined material insertable into said at least one opening wherein said at least one sleeve has at least one aperture for acceptance of at least one bottle.

2. The bottled beverage holding luggage of claim 1 wherein:

said at least one vertical wall predetermined material is shock-absorbing.

3. The bottled beverage holding luggage of claim 1 wherein:

said at least one horizontal wall predetermined material is shock-absorbing.

4. The bottled beverage holding luggage of claim 2 wherein:

said at least one horizontal wall predetermined material is shock-absorbing.

5. The bottled beverage holding luggage of claim 1 wherein:

said at least one sleeve predetermined material is shock-absorbing.

6. The bottled beverage holding luggage of claim 2 wherein:

said at least one sleeve predetermined material is shock-absorbing.

7. The bottled beverage holding luggage of claim 3 wherein:

said at least one sleeve predetermined material is shock-absorbing.

8. The bottled beverage holding luggage of claim 4 wherein:

said at least one sleeve predetermined material is shock-absorbing.

9. The bottled beverage holding luggage of claim 1 wherein:

said at least one vertical wall has a fabric of a predetermined material located thereon.

10. The bottled beverage holding luggage of claim 1 wherein:

said at least one horizontal wall has a fabric of a predetermined material located thereon.

11. The bottled beverage holding luggage of claim 1 wherein:

said at least one sleeve has a fabric of a predetermined material located within said at least one sleeve.

12. The bottled beverage holding luggage of claim 2 wherein:

said at least one sleeve has a fabric of a predetermined material located within said at least one sleeve.

13. The bottled beverage holding luggage of claim 3 wherein:

said at least one sleeve has a fabric of a predetermined material located within said at least one sleeve.

14. The bottled beverage holding luggage of claim 1 further comprising:

a luggage case sized and shaped for acceptance of said core.

15. The bottled beverage holding luggage of claim 14 wherein:

said luggage case has at least one wheel; and said luggage case has at least one handle.

16. The bottled beverage holding luggage of claim 14 further comprising:

a cushion base located between said core and said luggage case wherein said cushion base covers said at least one opening; and a cushion cover located between said core and said luggage case wherein said cushion cover covers said at least one opening.

17. A bottled beverage holding luggage comprising:

a core having a predetermined size and shape;

at least one vertical shock-absorbent wall made of a predetermined material located within said core;

at least one horizontal shock-absorbent wall made of a predetermined material located within said core wherein said at least one horizontal wall intersects with said at least one vertical wall;

at least one opening for acceptance of at least one bottle formed by said at least one vertical wall intersecting with said at least one horizontal wall;

at least one sleeve of a predetermined material insertable into said at least one opening wherein said at least one sleeve has at least one aperture for acceptance of at least one bottle;

said at least one sleeve having a fabric of a predetermined material located therein;

a luggage case sized and shaped for acceptance of said core wherein said luggage case has at least one wheel and at least one handle;

a cushion base located between said core and said luggage case wherein said cushion base covers said at least one opening; and a cushion cover located between said core and said luggage case wherein said cushion cover covers said at least one opening.

18. A bottled beverage holding luggage comprising:

a core having a predetermined size and shape;

at least one vertical slot located within said core;

at least one vertical shelf sized and shaped for insertion into said at least one vertical slot;

at least one horizontal slot located within said core;

at least one horizontal shelf sized and shaped for insertion into said at least one horizontal slot;

at least one opening for acceptance of at least one bottle formed by said at least one vertical shelf with said at least one horizontal shelf;

a luggage case sized and shaped for acceptance of said core;

a cushion base located between said core and said luggage case wherein said cushion base covers said at least one opening; and a cushion cover located between said core and said luggage case wherein said cushion cover covers said at least one opening.

19. The bottled beverage holding luggage of claim 18 wherein:

said at least one vertical shelf is removable from said at least one vertical slot.

20. The bottled beverage holding luggage of claim 18 wherein:

said at least one vertical shelf is removable from said at least one horizontal shelf.

21. The bottled beverage holding luggage of claim 18 wherein:

said at least one horizontal shelf is removable from said at least one horizontal slot.

22. The bottled beverage holding luggage of claim 19 wherein:

said at least one horizontal shelf is removable from said at least one horizontal slot.

23. The bottled beverage holding luggage of claim 20 wherein:

said at least one horizontal shelf is removable from said at least one horizontal slot.

24. The bottled beverage holding luggage of claim 19 wherein:

said at least one horizontal shelf is shock-absorbent.

25. The bottled beverage holding luggage of claim 19 wherein:

said at least one vertical shelf is shock-absorbent.

26. The bottled beverage holding luggage of claim 18 wherein:

said luggage case has at least one wheel; and said luggage case has at least one handle.

27. A bottled beverage holding luggage comprising:

a core having a predetermined size and shape;

at least one divider located within said core;

at least one opening for acceptance of at least one bottle formed by said at least one divider located within said core; and at least one means for securing said at least one bottle within said at least one opening wherein said at least one securing means is a strap.

28. The bottled beverage holding luggage of claim 27 wherein:

said at least one divider is foldable.

29. The bottled beverage holding luggage of claim 27 wherein:

said at least one divider is shock-absorbent.

30. The bottled beverage holding luggage of claim 28 wherein:

said at least one divider is shock-absorbent.

31. The bottled beverage holding luggage of claim 27 further comprising:

a lid securable to said core.

32. The bottled beverage holding luggage of claim 27 further comprising:

a luggage case sized and shaped for acceptance of said core.

33. The bottled beverage holding luggage of claim 32 further comprising:

a cushion base located between said core and said luggage case wherein said cushion base covers said at least one opening.

34. A bottled beverage holding luggage comprising:

a core having a predetermined size and shape;

at least one foldable divider located within said core;

at least one opening for acceptance of at least one bottle formed by said at least one divider located within said core;

at least one means for securing said at least one bottle within said at least one opening;

a cushion base located between said core and a luggage case wherein said cushion base covers said at least one opening; and a lid securable to said core.

* * * * *